United States Patent [19]

Temes

[11] 4,323,867

[45] Apr. 6, 1982

[54] FRAGMENT-TOLERANT TRANSMISSION LINE

[75] Inventor: Clifford L. Temes, Alexandria, Va.

[73] Assignee: The United States of America as represented by the Secretary of the Navy, Washington, D.C.

[21] Appl. No.: 181,926

[22] Filed: Aug. 27, 1980

[51] Int. Cl.[3] ..... H01P 3/12

[52] U.S. Cl. ..... 333/239; 138/178; 333/242

[58] Field of Search ..... 333/239, 242, 243, 244; 174/126 C; 245/8

[56] References Cited

U.S. PATENT DOCUMENTS

| | | | |
|---|---|---|---|
| 2,528,367 | 10/1950 | Iams | 333/239 |
| 3,195,079 | 7/1965 | Burton et al. | 333/239 |
| 3,290,426 | 12/1966 | Barrentine | 333/242 X |
| 3,522,561 | 8/1970 | Liu | 333/239 |
| 4,020,875 | 5/1977 | Akiba | 333/239 X |
| 4,205,420 | 6/1980 | Bothwell | 29/445 X |

FOREIGN PATENT DOCUMENTS

| | | | |
|---|---|---|---|
| 100036 | 1/1937 | Australia | 245/8 |

OTHER PUBLICATIONS

Wolf, *Magnesium Waveguides*, A. F. Technical Report No. 6504, Wright Air Development Center, Dec. 1950.

*Primary Examiner*—Paul L. Gensler
*Attorney, Agent, or Firm*—Robert F. Beers; William T. Ellis

[57] ABSTRACT

An improved transmission line or waveguide that can tolerate damage from ordnance fragments without severe degradation of performance. Ordnance fragment penetration into a waveguide tends to produce jagged inward protrusions or loose metal chips of the type which can cause arc-over and high standing wave ratios. The present invention provides a transmission line or waveguide made of a brittle nonconductive material such as plastic or composite material which is coated on the surfaces bordering the interior volume with a solder, conductive paint, or other conductive material. Thus, any penetration of the waveguide will leave a clean hole without jagged protrusions which could precipitate arcing and degrade the waveguide VSWR. An alternative embodiment comprises the construction of the waveguide walls from a brittle conductive material which would leave a clean hole after penetration.

1 Claim, 4 Drawing Figures

FRAGMENT-TOLERANT TRANSMISSION LINE

BACKGROUND OF THE INVENTION

The present invention relates generally to improvements in transmission lines and more particularly to new and improved transmission lines which can tolerate damage from ordnance fragments without severe degradation of performance.

Those concerned with the development of radar systems have long recognized the need for a transmission line or waveguide which can tolerate damage from ordnance fragments without severe degradation of performance. Specifically, prior art transmission lines and waveguides, when hit by fragments from sources such as exploding ordnance, tend to generate holes on the order of 1 inch or less in diameter. These holes, in and of themselves, tend not to have much effect on the VSWR of the transmission line or waveguide because their diameters are generally small compared to the wavelength of the electromagnetic energy propagating within the line. However, the inwardly-protruding, jagged metal edges generated by the act of penetration by the projectile will, in fact, decrease the breakdown voltage during radar transmissions. A decreased breakdown voltage in the waveguide will substantially increase the potential for arcing and degrade the voltage standing wave ratio (VSWR). Such arcing will not only lower the forward transmission efficiency of the waveguide but will also send potentially destructive energy traveling back toward the output stages, e.g., magnetron tube, in the radar transmitter.

OBJECTS OF THE PRESENT INVENTION

Accordingly, it is an object of the present invention to provide a transmission line or waveguide that will not suffer severe degradation of performance when hit by ordnance fragments.

A further object of the present invention is to prevent arc-over or a severely degraded VSWR in a waveguide struck by ordnance fragments.

A still further object of the present invention is to insure a clean hole with no jagged projections when a waveguide is struck by ordnance fragments.

A yet further object of the present invention is to protect radar transmitters by decreasing the probability of arc-overs in damaged transmission lines leading therefrom.

SUMMARY OF THE INVENTION

The above and other objects are obtained by providing in one embodiment a transmission line or waveguide with walls formed from a brittle conductive material and in another embodiment a transmission line or waveguide with walls formed from a brittle, nonconductive material with a thin conductive coating or lining on those wall surfaces of the waveguide which form the electromagnetic energy propagating surfaces. Such a construction will insure that any penetrating ordnance fragments will leave a clean hole in the transmission line or waveguide with substantially no inwardly protruding edges which could precipitate arcing and a degraded VSWR.

DETAILED DESCRIPTION OF THE PREFERRED EMBODIMENT

Figure 1:
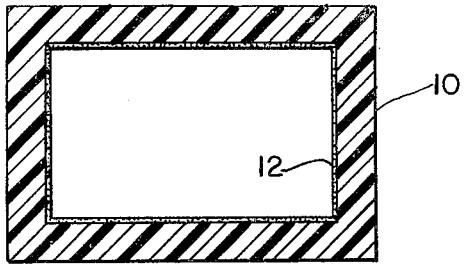
FIG. 1 is a cross-section view of a waveguide embodiment constructed in accordance with the present invention.

Referring now to the drawings, FIG. 1 shows a transmission line or waveguide for propagating electromagnetic energy comprising an outer structural housing or wall 10 constructed of brittle, nonconductive plastic, fiberglass, or composite material which will leave a clean hole when penetrated by ordnance fragments. This outer wall 10 is depicted for ease of explanation with a rectangular cross-sectional shape. However, as is well known in the art, this outer wall or shell cross-section may take a variety of shapes including square, circular, oval, etc. Outer wall 10 may be formed using a variety of methods well known in the art. For example, it may be convenient to manufacture it in accordance with a standard technique used for manufacturing plastic tubing such as injection molding. Regardless of the technique used for manufacture, the basic design requirement for this outer wall 10 is that it be made of a nonconductive material which is brittle enough that when it is penetrated by a projectile, it will leave a clean hole with substantially no inwardly protruding edges.

The transmission line or waveguide of FIG. 1 is designed to propagate electromagnetic energy within its interior surfaces. To this end, the inner surfaces of the wall 10 are coated or plated or layered with a conductive layer 12. This conductive layer may be formed from a wide variety of conductive materials. By way of example, this layer could be formed by a sprayed layer of conductive paint such as, for example, gold or silver leaf metal paint, or it could be formed by a thin layer of pressed conductive powder, or by a metal matrix composite material such as silicon carbide aluminum or graphite aluminum. This layer 12 could also be formed by a thin layer of solder via electroplating techniques, or formed with a thin layer of metallic foil, or via a metal plating technique. Finally the conductive layer might be formed by a thin conductive grid or mesh with the spaces therein small compared to the wavelength of the electro-magnetic energy propagating in the interior of the structure. The major design requirement for this conductive layer is that to be thin enough or brittle enough that it will break cleanly with substantially no jagged inwardly protruding edges when the transmission line or waveguide wall is penetrated by a projectile. In view of the tendency of electrical current to propagate on the surface of the conductive layer, especially at radio frequencies, this conductive layer can be made quite thin. The precise thickness. required for minimal losses will be determined by the frequency band being propagated in the transmission line or waveguide with standard transmission line formulas.

Accordingly, when a projectile penetrates the transmission line or waveguide of FIG. 1, the brittle outer housing or wall 10 with its thin interior layer or coating of conductive material will leave a relatively clean hole with substantially no inwardly protruding edges which would reduce the breakdown voltage in the line. Thus, there will be little chance of arc-over in the line with its concomitant threat to the transmitter. Moreover, if the hole is not large compared to the wavelength of the electromagnetic energy propagating in the transmission line or waveguide, then the VSWR thereof will be substantially unaffected by the penetration thereby allowing the continued operation of the equipment without significant degradation of performance.

Figure 2:
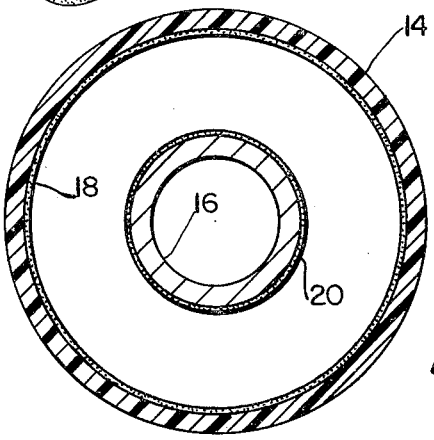
FIG. 2 is a cross-section view of a coaxial waveguide embodiment constructed in accordance with the present invention.

A coaxial transmission line embodiment of the present invention is shown in FIG. 2. This embodiment comprises an outer cylindrical housing or shell 14 with an inner concentric cylindrical housing or shell 16 both made from a brittle material such as that described for the housing of FIG. 1 which will leave a clean hole with substantially no protruding edges when penetrated by a projectile. Thin conductive layers 18 and 20 are then applied to the interior electromagnetic energy propagating surfaces of the housings 14 and 16, respectively. Accordingly, a penetrating projectile will leave a clean hole with substantially no protruding edges which might cause arc-over and a degraded VSWR.

Figure 3:
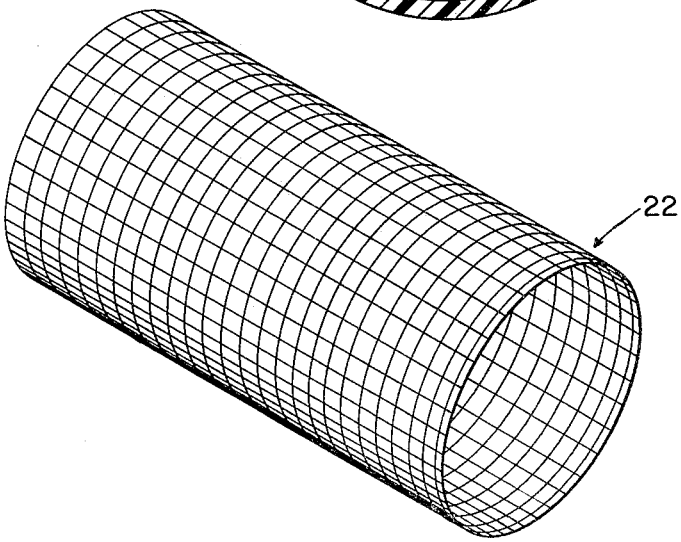
FIG. 3 is a perspective view of grid type waveguide constructed in accordance with the present invention.

FIG. 3 shows yet another embodiment of a transmission line or waveguide 22 constructed in accordance with the teachings of the present invention. This transmission line or waveguide 22 is formed using an open-grid or mesh construction. The cross-section of the grid shown is circular. However, it is clear that the cross-section could take a variety of shapes. The grid or mesh could be made from a brittle nonconductive material such as plastic or a composite dielectric material with a thin conductive layer such as a conductive paint coated on the interior electromagnetic energy propagating surfaces of the grid. A projectile impinging on such a grid structure would cause only limited damage and would leave either no hole or a clean hole in the structure with substantially no inwardly protruding edges which might induce arc-over and a degraded VSWR. The design requirement for the grid or mesh is that the grid holes therein be small compared to the wavelength of the electromagnetic energy being propagated within the structure.

In the alternative, the grid of FIG. 3 could be constructed of a brittle conductive material such as a metal matrix material which would disintegrate or vaporize upon contact with an ordnance projectile.

Figure 4:
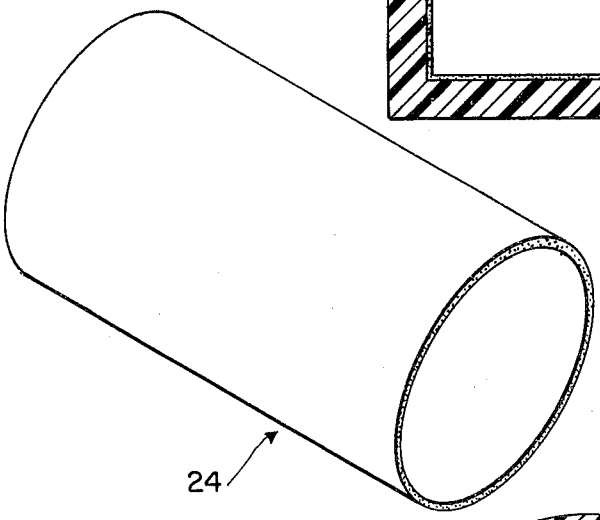
FIG. 4 is a perspective view of another embodiment of a waveguide constructed in accordance with the present invention.

FIG. 4 shows yet another embodiment of a transmission line or waveguide constructed in accordance with the present invention. The transmission line or waveguide 24 shown therein is cylindrical in shape with its thin walls constructed using standard techniques such as, for example, molding. Again, it is clear that this waveguide could have any of a variety of tubular cross-sectional shapes such as rectangular, square, oval, etc. The walls of the waveguide may be constructed of a brittle conductive material such as a compressed metal powder or a metal matrix material such as silicon carbide aluminum or graphite aluminum which will propagate electromagnetic energy. A projectile penetrating the brittle walls of such a waveguide would leave a clean hole with substantially no inwardly protruding edges which might induce arc-over and a degraded VSWR.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. An improved waveguide for propagating electromagnetic energy comprising:

a tubular grid made from a brittle, non-conductive material for propagating electromagnetic energy therethrough, wherein the openings in said grid are small compared to the wavelength of the electromagnetic energy to be propagated within said grid; and a thin coating of conductive material applied to the interior surfaces of said tubular grid which form the electromagnetic energy propagating surface of the waveguide, wherein said grid with its thin coating of conductive material is sufficiently brittle such that when penetrated by a projectile, it will have cleanly broken holes therethrough with substantially no inwardly protruding edges.

* * * * *